US006941938B2

(12) United States Patent
D'Arcy et al.

(10) Patent No.: US 6,941,938 B2
(45) Date of Patent: Sep. 13, 2005

(54) ADAPTER ASSEMBLY WITH FLOATING PIN FOR OPERABLY CONNECTING PRESSURIZED BOTTLE TO A PAINTBALL MARKER

(75) Inventors: Kenneth R. D'Arcy, Pittsford, NY (US); Edward G. Schultz, Jr., Rochester, NY (US); Todd D. Wilkinson, West Henrietta, NY (US)

(73) Assignee: Crossman Corporation, East Bloomfield, NY (US)

( * ) Notice: Subject to any disclaimer, the term of this patent is extended or adjusted under 35 U.S.C. 154(b) by 0 days.

(21) Appl. No.: 10/315,596

(22) Filed: Dec. 10, 2002

(65) Prior Publication Data

US 2004/0107951 A1 Jun. 10, 2004

(51) Int. Cl.[7] ..... F41B 11/32

(52) U.S. Cl. ..... 124/76; 124/74; 222/5; 137/68.3

(58) Field of Search ..... 124/74, 76; 137/683

(56) References Cited

U.S. PATENT DOCUMENTS

| | | | | | |
|---|---|---|---|---|---|
| 1,782,020 | A | * | 11/1930 | Allen | 222/5 |
| 2,047,049 | A | * | 7/1936 | Allen | 137/68.3 |
| 3,059,814 | A | * | 10/1962 | Poncel | 222/5 |
| 3,938,704 | A | * | 2/1976 | Milgram | 222/5 |
| 4,526,730 | A | | 7/1985 | Cochran et al. | |
| 4,844,123 | A | | 7/1989 | Wick | |
| 4,959,034 | A | * | 9/1990 | Wass | 441/41 |
| 5,076,468 | A | * | 12/1991 | Mackal | 222/5 |
| 5,161,738 | A | * | 11/1992 | Wass | 236/92 C |
| 5,496,865 | A | * | 3/1996 | Heese et al. | 521/79 |
| 5,647,390 | A | * | 7/1997 | Wass | 137/68.12 |
| 6,036,054 | A | | 3/2000 | Grill | |
| 6,196,255 | B1 | * | 3/2001 | Poillucci | 137/266 |
| 6,260,570 | B1 | * | 7/2001 | Wass et al. | 137/68.3 |
| 6,260,571 | B1 | * | 7/2001 | Lind et al. | 137/68.3 |
| 2001/0050076 | A1 | * | 12/2001 | Colby | 124/74 |

* cited by examiner

*Primary Examiner*—Michael J. Carone
*Assistant Examiner*—Troy Chambers
(74) *Attorney, Agent, or Firm*—Brian B. Shaw, Esq.; Stephen B. Salai, Esq.; Harter, Secrest & Emery

(57) ABSTRACT

An adapter assembly for releasably interconnecting a pressurized bottle with a paintball marker, wherein the adapter assembly includes a piercing pin moveable between retracted position and an extended position. The adapter assembly includes an internally threaded female socket for releasably engaging the pressurized bottle, and an externally threaded male head for releasably engaging a corresponding female connector on the paintball marker. The spacing of the threaded connections and the travel of the piercing pin are selected such that the piercing pin punctures a frangible seal of the pressurized bottle subsequent to fluid interconnection of both the pressurized bottle and the paintball marker with the adapter assembly.

25 Claims, 3 Drawing Sheets

ADAPTER ASSEMBLY WITH FLOATING PIN FOR OPERABLY CONNECTING PRESSURIZED BOTTLE TO A PAINTBALL MARKER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to a paintball marker, and more particularly to an adapter assembly for operably connecting a pressurized propellant source to the marker.

2. Description of Related Art

Paintball markers employ compressed gas to provide the motive force (propellant) for the paintballs. The compressed gas is retained in a pressurized container, wherein the size of the container generally determines amount compressed gas available for projecting the paintballs. Thus, paintball marker user must balance the larger capacity of rechargeable, large volume tanks with their relative bulk and weight against smaller, lighter disposable tanks having less capacity.

As the volume of the pressurized bottle increases, the energy stored within the bottle increases. This increased energy can create handling concerns.

Therefore, the need exists for an assembly for enhancing the operable interconnection of a pressurized bottle with a paintball marker. A need further exists for a method by which disposable pressurized bottles can be selectively and releasably engaged with a paintball marker.

BRIEF SUMMARY OF THE INVENTION

The present invention provides an adapter assembly for interconnecting a pressurized bottle with a paintball marker, wherein pressurized fluid within the bottle is not exposed to the marker until the adapter assembly is engaged with both the paintball marker and the bottle. That is, the adapter assembly is directed to reducing venting of the pressurized bottle, unless the bottle is engaged with the adapter assembly and the adapter assembly is engaged with the paintball marker. Thus, the adapter assembly can cooperatively engage a disposable pressurized bottle, and fluidly connect the bottle to a paintball marker prior to puncturing (opening) the bottle.

Generally, a configuration of the adapter assembly includes an adapter body having a female socket for receiving a portion of the pressurized bottle, a male head for engaging the paintball marker and a passage through the head, and a piercing pin movably connected to the adapter body between a retracted position and an extended position. The female socket can include means for releasably engaging the pressurized bottle and the male head can include means for releasably engaging the paintball marker.

In a further configuration, it is contemplated the female socket of the adapter body is internally threaded and the male head is externally threaded. A configuration of the adapter assembly also provides the piercing pin is movably disposed within a portion of the passage. In a preferred configuration, the female socket and the male head form a sealed interface with a corresponding surface of the bottle and the paintball marker, respectively.

One configuration of the adapter assembly provides for releasably engaging an adapter body having a movable piercing pin with a pressurized bottle, and subsequently releasably engaging the adapter body with the paintball marker so that the piercing pin then punctures the pressurized bottle. That is, in its intended use, the adapter body cooperatively engages the pressurized bottle without puncturing the bottle and the coupled bottle and adapter body are then engaged with the paintball marker such that the piercing pin of the adapter body punctures the pressurized bottle after the adapter assembly is cooperatively engaged by the marker and a sealed interface has been created.

BRIEF DESCRIPTION OF THE SEVERAL VIEWS OF THE DRAWING(S)

DETAILED DESCRIPTION OF THE INVENTION

Figure 2:
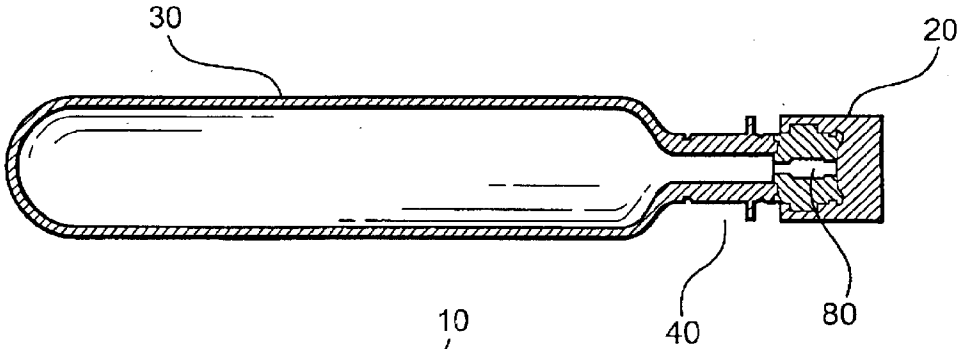
FIG. 2 is a cross sectional view showing the pressurized bottle and a female connector of the paintball marker cooperatively engaged with the adapter assembly.
Figure 1:
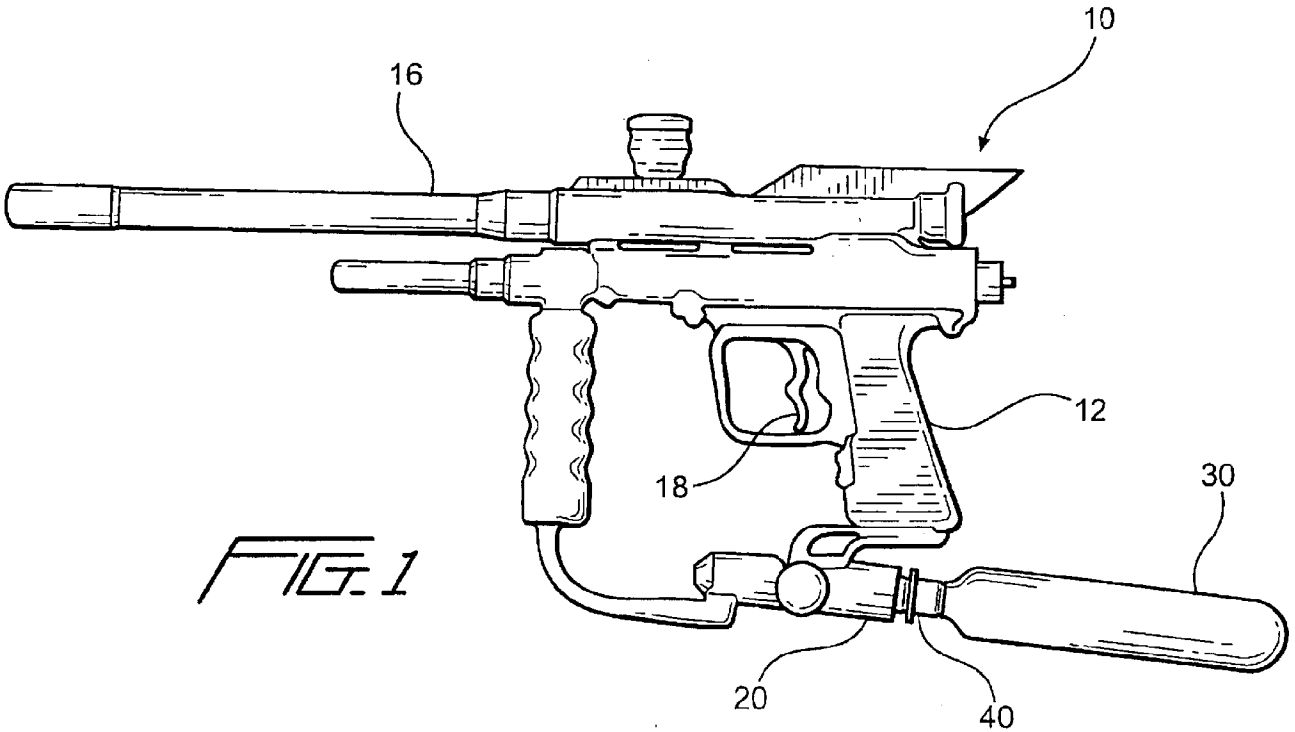
FIG. 1 is a side elevational view showing a paintball marker cooperatively engaged with the adapter assembly, and the adapter assembly cooperatively engaged with a pressurized bottle.

Referring to FIG. 1, a paintball marker 10 is shown operably interconnected to a pressurized bottle 30 by an adapter assembly 40.

Paintball Marker

The paintball marker 10 generally includes a grip 12, a hopper for retaining a plurality of paintballs to be discharged, a barrel 16 and a trigger 18.

Figure 3:
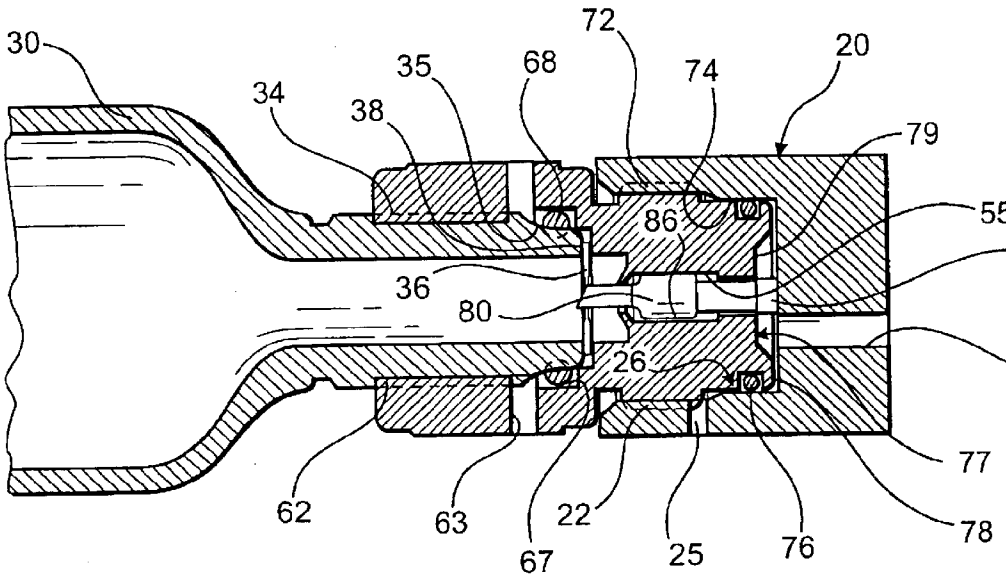
FIG. 3 is an enlarged cross sectional view showing the adapter assembly operably engaged with the pressurized bottle and the female connector of the paintball marker.
Figure 4:
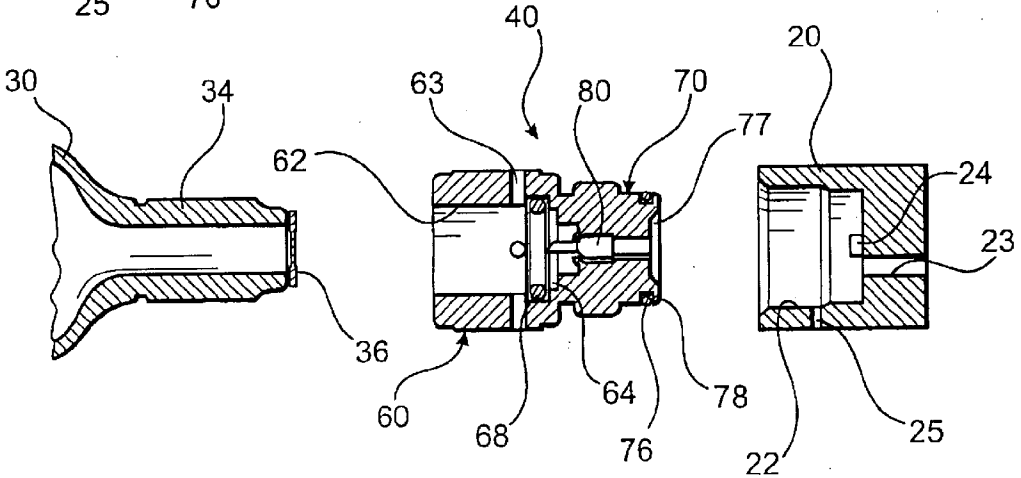
FIG. 4 is a cross sectional view of a portion of the pressurized bottle, the adapter assembly and the female connector of the paintball marker.
Figure 6:
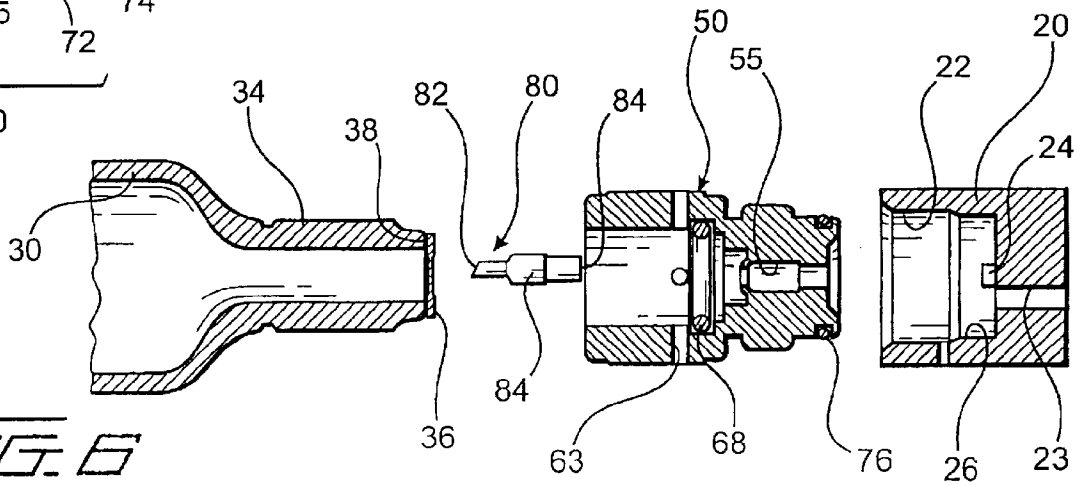
FIG. 6 is an exploded view of a portion of the pressurized bottle, the adapter assembly and the female connector of the paintball marker.

The paintball marker 10, as seen in FIGS. 3, 4, and 6 includes female connector 20 for engaging an external propellant source. In one configuration the female connector 20 preferably includes internal threads 22. A duct 23 extends from the female connector 20 to a firing mechanism of the paintball marker 10. As seen in FIGS. 3, 4 and 6, an actuating stand off 24 projects from an inner end of the female connector 20. The stand off 24 is located to align with a predetermined portion of the adapter assembly 40 upon operably engagement of the adapter assembly with the female connector 20. The female connector 20 includes a transverse vent 25. The female connector 20 further includes a sealing portion 26 for contacting a portion of the adapter assembly 40 to form a sealed interface therebetween.

Further, although the female connector 20 of the paintball marker 10 is shown adjacent the grip 12, it is understood the female connector can be located at any of a variety of locations relative to the paintball marker. That is, the female connector 20 can be attached to any available portion of the marker in either a permanent or releasable connection.

Pressurized Bottle

The pressurized bottle 30 is constructed to retain a propellant such as a compressed gas or a combination of gases. While the pressurized bottle 30 can be any of a variety of sizes, various governmental rules and regulations apply to various modes of transport of certain bottle configurations. Thus, the particular size, weight, capacity and configuration of the bottle is often, at least partially dictated by these regulations.

The pressurized bottle 30 can be referred to as a container, tank or vessel and can be disposable, single use, rechargeable or refillable. For purposes of the description, the pressurized bottle 30 is set forth as a disposable bottle retaining an initial amount of pressurized propellant.

Referring to FIG. 4, the pressurized bottle 30, in relevant part, includes a male connector 32 having an external threaded surface 34 and a frangible, or pierceable seal 36 located on an annular seat 38. The pierceable seal 36 and the attachment of the seal to the annular seat 38 are known in the art. That is, the seal 36 can be limited to an overlying seal, or can be incorporated into a cap structure. The pressurized bottle 30 further includes a seating surface 35. The seating surface 35 is generally frustoconical, but can be any of a variety of shapes that can cooperate with a corresponding portion of the adapter assembly 40.

Adapter Assembly

Figure 5:
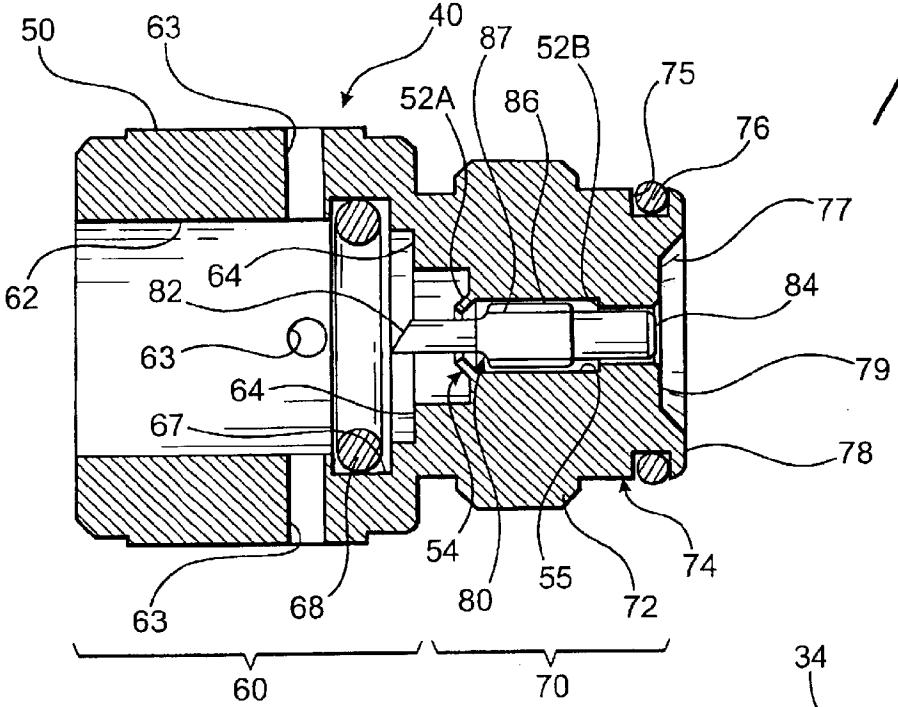
FIG. 5 is an enlarged cross sectional view of the adapter assembly.

Referring to FIGS. 3, 4 and 5, a configuration of the adapter assembly 40 includes an adapter body 50 and a piercing pin 80 moveably connected to the adapter body between an extended position and a retracted position.

The adapter body 50 includes a female socket 60 for engaging the pressurized bottle 30 and a male head 70 for engaging the paintball marker 10. In one configuration, the female socket 60 includes internal threads 62 and the male head includes external threads 72. A passage 55 extends from the female socket 60 and through the male head 70.

The female socket 60 includes a positive stop 64 for limiting penetration of the bottle 30 into the socket. The positive stop 64 can have any of a variety of configurations, but is shown as an internal shoulder. The female socket 60 also includes an annular groove 67 longitudinally intermediate the positive stop 64 and the open end of the female socket 60. It is understood the longitudinal direction extends along the axis of the adapter body, and is coincident with the axis about which the body rotates during threaded engagement with the pressurized bottle 30 or the female connector 20. An O-ring 68 is disposed in the groove 67 for forming a sealing interface with the sealing section 35 of the pressurized bottle 30. The female socket 60 of the adapter assembly 40 includes at least one, and preferably a plurality, such as four or more radial vents 63. As seen in FIGS. 3, 4 and 5, the radial vents are longitudinally intermediate the O-ring 68 and the open end of the female socket 60.

The male head 70 defines an outer surface having the threads 72 and a sealing section 74, wherein the threads are intermediate the sealing section and the female socket 60. The sealing section 74 includes a peripheral groove 75 into which a seal 76, such as an O-ring, is disposed.

A terminal end of the male head 70 includes a recess 77, such that the passage 55 terminates in the recess. The recess 77 is sized to provide fluid communication from the passage 55 to the duct 23 in the paintball marker 10 upon any rotational orientation of the adapter assembly 40. The recess 77 is at least partially defined by an annular ridge 78, thereby defining a central floor 79.

As seen in FIGS. 3 and 4, the piercing pin 80 is disposed within the passage 55 and moveable between an extended position and a retracted position. In one configuration, the passage 55 and the piercing pin 80 are sized to provide a generally annular flow path therebetween. An end of the piercing pin projecting into the female socket 60 is configured as a penetrating surface 82 for selectively contacting and piercing the frangible seal 36 of the pressurized bottle 30. The penetrating surface 82 can be faceted or angled for enhancing puncturing of the frangible seal 36 on the pressurized bottle 30. The piercing pin 80 has a driven end 84 for contacting the stand off 24.

The piercing pin 80 can be moveably coupled to the adapter body 50 by any of a variety of mechanisms. Grooves, slides or guide ribs can be used to define the travel of the piercing pin 80 relative to the adapter body 50. As seen in FIGS. 3–5, the piercing pin 80 includes a longitudinally extending bulbous portion 86. The passage 55 in the adapter body 50 includes a pair of spaced shoulders 52A and 52B to capture the bulbous portion 86 therebetween. The distance between the shoulders 52A and 52B and the sizing of the bulbous portion 86 dictate the range of motion of the piercing pin 80 between the retracted position and the extended position. In one configuration, the components are selected to locate the driven end 84 of the piercing pin 80 in the retracted position substantially flush with an adjacent portion of the central floor 79 of the male head 70. In this configuration, the driven end 84 is depressed from the central floor 79 upon the piercing pin 80 being disposed in the extended position.

The shoulders 52A and 52B can be formed in any of a variety of configurations. For ease of manufacturing one of the shoulders 52A can be formed from a flange or flanges 54 that are deformed or bent into operable position. Referring to FIGS. 3 and 5, the adapter body 50 includes an annular deformable flange 54 at the terminal end of the passage 55 in the female socket 60. The flanges 54 are formed in an open position allowing the piercing pin 80 to be disposed within the passage 55. The flange 54 is then bent to form the shoulder 52A for limiting travel of the piercing pin 80 into the female socket 60. The shoulder 52B can be integrally formed in the adapter body 50.

Although not required, it is contemplated the adapter assembly 40 can comply with an industry standard, such as ASTM F 1750–96, Standard Specification for Paintball Gun Threaded-Propellant Source Interface, herein incorporated by reference. In part, the Standard dictates male and female threaded connectors for interfacing a propellant source and a paintball gun (marker). The standard requires the female connector is configured as part of the paintball gun and the male connector is configured as part of the propellant source. The male and female connectors are made form materials compatible with carbon dioxide ($CO_2$). The materials and processes used to manufacture the male and female connectors result in items with mechanical strength sufficient to pass 3000 psig proof pressure check without failure or degradation to function.

Operation

In a preferred operation, the adapter assembly 40 is initially engaged with the female connector 20 of the paintball marker 10, and the pressurized bottle 30 is then engaged with the adapter assembly. In this process, the external threads 72 of the male head 70 are cooperatively engaged with the corresponding internal threads 22 of the female connector 20. As the adapter assembly 40 is threadingly engaged with the paintball marker 10, a sealed interface is formed between the O-ring seal 76 of the male head sealing section 74 and the sealing portion 26 of the female connector 20. In addition, the stand off 24 is aligned with the passage 55 and hence the piercing pin 80.

As the terminal end of the male head 70 approaches the closed end of the female connector 20, the stand off 24 contacts the driven end 84 of the piercing pin 80, thereby initiating movement of the piercing pin toward the extended position. Upon fully engaging the adapter assembly 40 with the female connector 20, the stand off 24 contacts the piercing pin 80 and disposes the piercing pin in the extended position. Subsequently, the internal threads 62 of the female socket 60 in the adapter assembly 40 are threadedly engaged with the corresponding threaded external surface 34 of the pressurized bottle 30. Prior to the piercing pin 80 contacting and puncturing the seal 36, the O-ring seal 68 contacts the seating surface 35 of the pressurized bottle 30 and forms a sealed interface therebetween. Continued threaded engagement at least maintains, or can increase the capacity of the sealed interface between the adapter assembly 40 and the pressurized bottle 30. Preferably, a plurality of additional turns of the adapter assembly 40 (or bottle 30) are required for the piercing pin 80 to contact and puncture the seal 36. After penetration of the seal 36, continued engagement of the pressurized bottle 30 and the adapter assembly 40 is limited by contact of the bottle and the positive stop 64.

Thus, upon operably engaging the adapter assembly 40 with the female connector 20, a fluid interconnection is formed therebetween. As the pressurized bottle 30 is then engaged with the adapter assembly 40, a sealed interface is formed between the bottle and the adapter assembly prior to the piercing pin penetrating the seal 36.

Alternatively, the adapter assembly 40 can be initially engaged with the pressurized bottle 30, and the adapter assembly then engaged with the female connector 20 of the paintball marker 10. In this approach, the internal threads 62 of the female socket 60 in the adapter assembly 40 are threadedly engaged with the corresponding threaded external surface 34 of the pressurized bottle 30. Continued threaded engagement causes the O-ring 68 to contact the seating surface 35 of the pressurized bottle 30 and formation of a sealed interface therebetween. After the sealed interface is formed between the seating surface 35 and the O-ring 68, further threaded engagement continues until the pressurized bottle 30 contacts the positive stop 64. As the adapter assembly 40 is threaded onto the pressurized bottle 30, the piercing pin 80 may contact the pierceable seal 36. Contact of the piercing pin 80 with the seal 36 urges the pin toward the retracted position. Thus, the piercing pin 80 travels toward the male head 70 of the adapter body 50 and does not puncture the seal 36. As the piercing pin 80 moves toward the retracted position a sufficient distance to preclude penetrating the seal 36, the driven end 84 is substantially flush with the adjacent portion of the central floor 79, and is thereby partially protected by the annular ridge 78 from unintentional contact which could urge the pin toward the extended position, and possible penetration of the seal 36. Movement of the piercing pin 80 toward the retracted position prevents the pin from puncturing the seal 36. The pressurized bottle 30 is thus fully engaged with the adapter assembly 40, thereby fluidly connecting the passage 55 and the seal 36, and the piercing pin 80 is moved to the retracted position and does not puncture or penetrate the seal of the bottle.

The coupled adapter assembly 40 and pressurized bottle 30 are then engaged with the paintball marker 10. Specifically, the external threads 72 of the male head 70 engage the internal thread 22 of the female connector 20 of the paintball marker 10. As the adapter assembly 40 is threadedly engaged with the paintball marker 10, a sealed interface is formed between the O-ring 76 of the male head sealing section 74 and the sealing portion 26 of the female connector 20. In addition, the stand off 24 is aligned with the passage 55 and hence the piercing pin 80.

As the terminal end of the male head 70 approaches the closed end of the female connector 20 and after the sealed interface has been formed between the adapter assembly 40 and the female connector 20, the stand off 24 contacts the driven end 84 of the piercing pin 80, thereby initiating movement of the piercing pin from the retracted position toward the extended position. The penetrating surface 82 of the piercing pin 80 contacts the pierceable seal 36 of the pressurized bottle 30.

At this position, the O-ring 68 in the female socket 60 has formed a sealed interface with the seating surface 35 of the pressurized bottle 30. In addition, the sealing section 74 of the male head 70 and the sealing portion 26 of the female connector 20 have formed a sealed interface. Thus, fluid communication is provided from the duct 23 to the pierceable seal 36.

Continued rotation of the adapter assembly 40 relative to the female connector 20 further urges the penetrating surface 82 of the piercing pin 80 to penetrate the pierceable seal 36. Further rotation of the adapter assembly relative to the female connector 20 is terminated upon contact of the annular ridge 78 with the end of the female connector. As the seal 36 is penetrated, the pressurized propellant then flows from the disposable bottle 30 through the ruptured seal 36, through the passage 55 of the adapter assembly 40, the recess 77 and into the duct 23 of the paintball marker 10.

If a partially pressurized, or empty bottle 30 is removed from the adapter assembly 40, as the adapter assembly is engaged with the female connector 20, both the bottle 30 and the paintball marker 10 will bleed or vent to ambient pressure. Specifically, as the bottle 30 is unthreaded from the adapter assembly 40, any remaining pressure in the bottle will vent through vents 63 in the adapter body 50. Pressure from the paintball marker 10, expressed in the duct 23, will urge the piercing pin 80 to the fully extended position. In the fully extended position, the bulbous portion 86 contacts the shoulder 52A in the female socket 60. Contact of the bulbous portion 86 with the shoulder 52A does not form a sealed interface precluding fluid flow through the passage 55. The shoulder 52A is formed to preclude a sealed interface between the shoulder and the piercing pin 80. That is, less than the entire flange 54 can be deformed to form the shoulder 52A. Those portions of the flange 54 that are not formed into the shoulder 52A are thus spaced from bulbous portion 86 and provide a flow path therebetween. The flow path through the passage 55 can also be provided by any of a variety of structures including a longitudinally extending groove or channel 87 in the bulbous portion 86. In a further construction, the piercing pin 80 can be a hollow member having a central passageway therethrough.

If the adapter assembly 40, with a connected partially pressurized bottle 30, is removed from the female connector 20 of the paintball marker 10, the paintball marker will vent to ambient pressure, and the bottle may bleed to ambient pressure or remain substantially sealed to the adapter assembly. Specifically, when the adapter assembly 40 and a partially pressurized bottle 30 are removed from the paintball marker, pressure in the duct 23, will vent to ambient pressure through the vent 25 in the female connector 20. Pressure remaining in the bottle 30 will urge the piercing pin 80 to the fully retracted position, such that the bulbous portion 86 contacts the shoulder 52B. The interface between piercing pin 80 in the retracted position and adapter body 50 can be constructed to provide either a relatively slow bleed of the pressure in the bottle 30 along the interface, or a substantially sealed interface. In the bleed configuration, the interface allows pressure to bleed without creating a significant propulsive force on the bottle. In the relatively sealed interface, the coupled adapter assembly 40 and bottle 30 could be removed from a first paintball marker and engaged with a second paintball marker, without significant loss of propellant. The interface between the piercing pin 80 in the retracted position and the adapter body 50 can include at least one groove or channel to provide the bleed, or be mating surfaces substantially forming a seal therebetween.

Although the adapter assembly 40 has been described in terms of male and female threaded interfaces, it is contemplated any of a variety of releasable mechanisms such as bayonet, detent snap, rings or even friction fits can be employed. Alternatively, or additionally clamps or external retainers can be employed.

The adapter assembly 40 thus provides that the frangible seal 36 of the pressurized bottle 30 is not compromised (punctured) until the adapter assembly 40 is sufficiently engaged with the paintball marker 10 to preclude unintended separation of the bottle from the adapter assembly (and hence paintball marker 10). Therefore, upon puncturing the pierceable seal 36, the adapter assembly 40 is sufficiently engaged with both the bottle 30 and the paintball marker 10 to reduce occurrence of uncontrolled puncturing of the pressurized bottle.

It is understood there is a relation between the length of travel of the piercing pin 80 (between the retracted position and the extended position) and the sealing interface formed between the male head 70 and the female connector 20. That is, the male head 70 and the female connector 20 define a sealed interface of sufficient longitudinal distance to allow the piercing pin 80 to travel a sufficient distance to puncture the pierceable seal 36. Conversely, upon the adapter assembly 40 being operably engaged with the female connector 20 (thereby disposing the piercing pin 80 in the extended position), the adapter assembly is configured to form a sealed interface with the seating surface 35 of the pressurized bottle 30 prior to the piercing pin penetrating the seal 36 and exposing the adapter assembly to the pressurized propellant.

While the invention has been described in connection with a presently preferred embodiment thereof, those skilled in the art will recognize that many modifications and changes made be made therein without departing from the spirit and scope of the invention, which accordingly is intended to be defined solely by the appended claims.

What is claimed is:

1. An adapter assembly comprising:

(a) an adapter body having an internally threaded socket, an externally threaded head coaxially aligned with the internally threaded socket, and a passage through the head, the threaded socket including a positive stop, an O-ring and a vent, wherein the O-ring is longitudinally intermediate the positive stop and the vent; and (b) piercing pin moveably connected to the adapter body within the passage between a retracted position and an extended position.

2. The adapter assembly of claim 1, wherein the piercing pin is in a piercing position in the extended position.

3. The adapter assembly of claim 1, wherein the adapter body includes a pair of spaced shoulders selected to limit movement of the piercing pin between the retracted position and the extended position.

4. The adapter assembly of claim 1, wherein at least a portion of the piercing pin is disposed in the passage to define a flow path therebetween.

5. An adapter assembly fluidly connecting a pressurized bottle with paintball marker, the adapter assembly comprising:

(a) an adapter body having a through passage, means for releasably engaging the bottle and means for releasably engaging the paintball marker, the through passage including an internal shoulder, an O-ring and a vent, wherein the O-ring is longitudinally intermediate the internal shoulder and the vent; and (b) a pin moveably connected to the adapter body in the through passage between a retracted position and an extended position, the pin forming a substantially sealed interface with the internal shoulder in the retracted position.

6. The adapter assembly of claim 5, wherein the adapter body and the pin are selected to dispose the pin in the extended position in response to operably engaging the adapter body with the paintball marker.

7. The adapter assembly of claim 5, wherein the pin includes a driven end, the driven end sized to contact the paintball marker in the extended position.

8. The adapter assembly of claim 5, wherein the means for releasably engaging the bottle includes a threaded connection.

9. The adapter assembly of claim 5, wherein the means for releasably engaging the paintball marker includes a threaded connection.

10. An adapter assembly fluidly connecting a pressurized bottle with a paintball marker, the adapter assembly comprising:

(a) a piercing pin moveable between a retracted position and an extended position the piercing pin sized to contact the paintball marker in the extended position in operable engagement of the adapter assembly with the paintball marker.

11. The adapter assembly of claim 10, wherein the piercing pin is sized to project from an adjacent portion of the paintball marker in the retracted position.

12. The adapter assembly of claim 10, further comprising an adapter body, wherein the piercing pin is moveably connected to the adapter body.

13. The adapter assembly of claim 12, wherein the piercing pin includes a driven terminal end, the driven terminal end sized to contact the paintball market in the extended position.

14. The adapter assembly of claim 12, wherein the adapter body includes a female socket for engaging the pressurized bottle, the female socket including a seal for forming a sealed interface with the pressurized bottle.

15. An adapter assembly releasably fluidly connecting a pressurized bottle to a paintball marker, the paintball marker having a standoff, the adapter assembly comprising:

(a) an adapter body having sealing means forming a sealed interface with a portion of the pressurized bottle and means for releasably engaging the adapter body with the pressurized bottle;

(b) a moveable pin connected to the adapter body and sized to contact the standoff to move to an extended position; and (c) engaging means for engaging the adapter body with the paintball marker.

16. The adapter assembly of claim 15, wherein the sealing means includes a seal in a female socket of the adapter body.

17. An adapter assembly fluidly connecting a pressurized bottle to a paintball marker, the adapter assembly comprising:

(a) an adapter body having a passage, first means for forming a sealed interface between the adapter body and the pressurized bottle and second means for forming a sealed interface between the adapter body and the paintball marker, and (b) a piercing pin moveably connected to the adapter body between a retracted position and an extended position, wherein the piercing pin contacts the paintball marker to move to the extended position upon a sealed interface between the passage and the paintball marker.

18. The adapter assembly of claim 17, wherein the first means for forming a sealed interface forms the sealed interface prior to piercing pin penetrating the bottle.

19. An adapter assembly releasably fluidly connecting a pressurized bottle to a paintball marker, the adapter assembly comprising:

(a) an adapter body releasably engaging the pressurized bottle and the paintball marker, the adapter body including a through passage; and (b) a pin connected to the adapter body within the through passage to be moveable between an open position and a flow restricting position, the pin sized to contact the paintball marker to dispose the pin in the open position.

20. The adapter assembly of claim 19, wherein the pin includes a bulbous portion and the through passage includes a shoulder, the bulbous portion and the shoulder are sized to contact and from at least a substantially sealed interface therebetween.

21. The adapter assembly of claim 19, wherein the flow restricting position of the pin precludes flow through the passage from the pressurized bottle to the paintball marker.

22. The adapter assembly of claim 19, wherein an end of the pin projects from an adjacent portion of the adapter body in the flow restricting position of the pin.

23. An adapter assembly releasably fluidly connecting a pressurized bottle to a paintball marker having an actuating stand off; the adapter assembly comprising:

(a) an adapter body releasably engaging the pressurized bottle and the paintball marker, the adapter body including a through passage, a positive stop, an O-ring and a vent, wherein the O-ring is longitudinally intermediate the positive stop and the vent; and (b) a pin in the through passage, the pin moveable between an open position and a flow restricting position, the pin sized to contact the actuating stand off to move to the open position.

24. The adapter assembly of claim 23, wherein the passage includes a seat and the pin includes a shoulder, the seat and the shoulder sized to contact in the flow restricting position of the pin.

25. The adapter assembly of claim 23, wherein an end of the pin projects from an adjacent portion of the adapter body in the flow restricting position on the pin.

* * * * *

UNITED STATES PATENT AND TRADEMARK OFFICE

CERTIFICATE OF CORRECTION

PATENT NO. : 6,941,938 B2 
APPLICATION NO. : 10/315596
DATED : September 13, 2005
INVENTOR(S) : Kenneth R. D'Arcy, Edward G. Schultz, Jr. and Todd D. Wilkinson It is certified that error appears in the above-identified patent and that said Letters Patent is hereby corrected as shown below:

Title page, column 1, Item (73) Assignee:
Delete "Crossman" and insert --Crosman--.

Column 8, line 11, after "bottle with" insert -- a --. (Claim 5)

Column 8, line 52, delete "market" and insert --marker--. (Claim 8)

Column 10, line 2, delete "from" and insert -- form --. (Claim 20)

Signed and Sealed this

Thirteenth Day of March, 2007

JON W. DUDAS
*Director of the United States Patent and Trademark Office*